US009577363B2

(12) United States Patent
Lutz et al.

(10) Patent No.: US 9,577,363 B2
(45) Date of Patent: Feb. 21, 2017

(54) ELECTRICAL PLUG DEVICE FOR CONNECTION OF A MAGNET COIL AND/OR OF A SENSOR ELEMENT

(71) Applicant: Robert Bosch GmbH, Stuttgart (DE)

(72) Inventors: Bernd Lutz, Kempten (DE); Martin Winkler, Sonthofen (DE); Gerold Kohlberger, Rettenberg-Freidorf (DE); Bernd Kellner, Waltenhofen (DE)

(73) Assignee: Robert Bosch GmbH, Stuttgart (DE)

( * ) Notice: Subject to any disclaimer, the term of this patent is extended or adjusted under 35 U.S.C. 154(b) by 51 days.

(21) Appl. No.: 14/554,096

(22) Filed: Nov. 26, 2014

(65) Prior Publication Data

US 2015/0147912 A1 May 28, 2015

(30) Foreign Application Priority Data

Nov. 27, 2013 (DE) ..... 10 2013 224 296

(51) Int. Cl.

| | |
|---|---|
| ***H01R 9/22*** | (2006.01) |
| ***H01R 13/504*** | (2006.01) |
| ***H01R 43/02*** | (2006.01) |
| *H01R 13/66* | (2006.01) |
| *H01R 43/24* | (2006.01) |
| *H01R 13/405* | (2006.01) |

(52) U.S. Cl.

CPC ..... *H01R 13/5045* (2013.01); *H01R 43/0207* (2013.01); *H01R 43/0221* (2013.01); *H01R 13/405* (2013.01); *H01R 13/6683* (2013.01); *H01R 43/24* (2013.01); *H01R 2201/26* (2013.01)

(58) Field of Classification Search

None

See application file for complete search history.

(56) References Cited

U.S. PATENT DOCUMENTS

| | | | | |
|---|---|---|---|---|
| 4,292,947 | A * | 10/1981 | Tanasawa | F02M 51/0682 123/445 |
| 5,211,682 | A * | 5/1993 | Kadowaki | F02M 51/0671 123/432 |
| 5,217,036 | A * | 6/1993 | Maier | F02M 51/0614 137/1 |
| 5,238,429 | A * | 8/1993 | Margrave | H01R 13/6683 439/620.21 |
| 6,446,606 | B1 * | 9/2002 | Krimmer | F02M 59/34 123/446 |
| 6,821,162 | B2 * | 11/2004 | Mott | H01R 13/04 439/722 |

(Continued)

*Primary Examiner* — Tho D Ta

(74) *Attorney, Agent, or Firm* — Maginot, Moore & Beck LLP

(57) ABSTRACT

An electrical plug device is configured for the connection of a magnet coil and/or of a sensor element to a contact partner of a counterpiece cooperating with the electrical plug device. The electrical plug device has at least one first portion, which comprises the magnet coil and/or the sensor element and at least one electrical contact element. The magnet coil and/or the sensor element and the at least one electrical contact element of the first portion are non-detachably interconnected. The electrical plug device also has a second portion, which is produced separately from the first portion and is type-specific in relation to the counterpiece. The second portion is joined to the first portion and surrounds the electrical contact element, at least in part.

16 Claims, 6 Drawing Sheets

(56) References Cited

U.S. PATENT DOCUMENTS

| | | | | |
|---|---|---|---|---|
| 7,452,247 | B1 * | 11/2008 | Rahman | B29C 45/1671 264/272.11 |
| 2005/0115543 | A1 * | 6/2005 | Rembold | F02M 59/34 123/446 |
| 2010/0126474 | A1 * | 5/2010 | Siegel | F02M 59/34 123/508 |
| 2010/0288233 | A1 * | 11/2010 | Wieland | F02M 59/205 123/446 |
| 2012/0152208 | A1 * | 6/2012 | Landenberger | F02M 59/36 123/510 |

* cited by examiner

FIG. 2
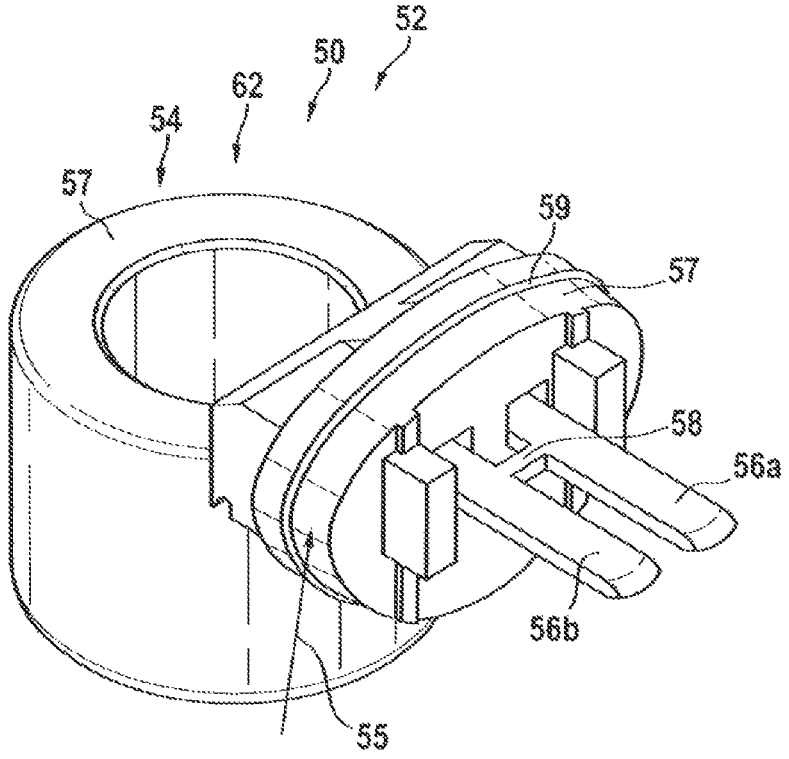
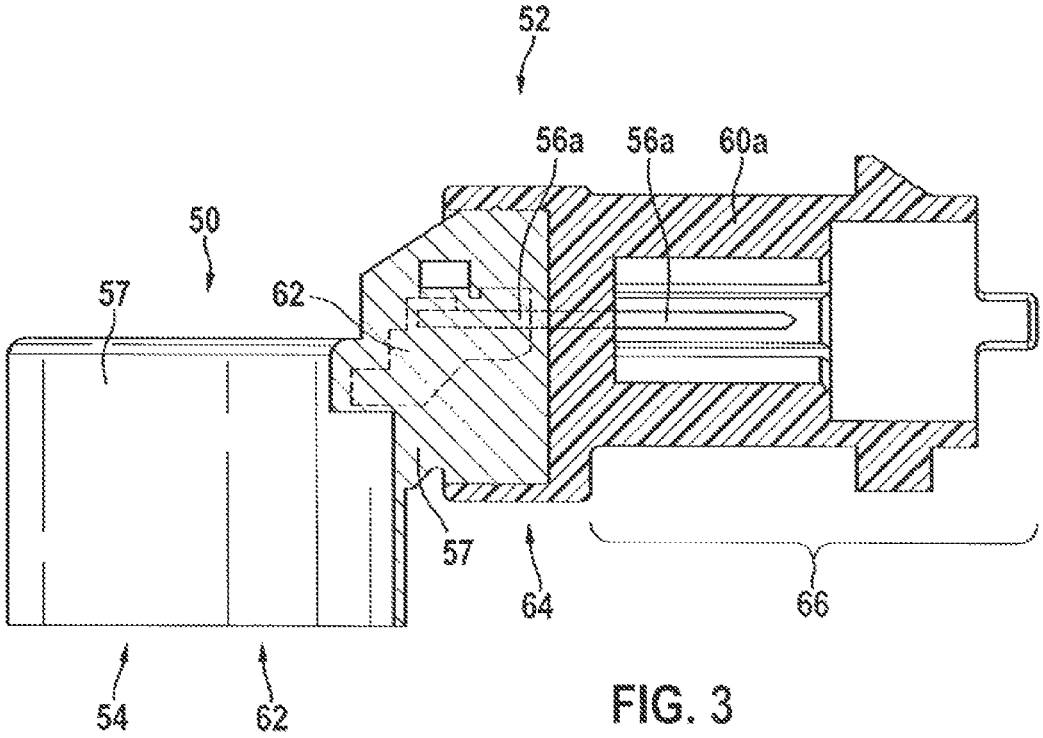
FIG. 3

ELECTRICAL PLUG DEVICE FOR CONNECTION OF A MAGNET COIL AND/OR OF A SENSOR ELEMENT

This application claims priority under 35 U.S.C. §119 to patent application number DE 10 2013 224 296.4, filed on Nov. 27, 2013 in Germany, the disclosure of which is incorporated herein by reference in its entirety.

BACKGROUND

The disclosure relates to an electrical plug device and to a volume control valve and a method.

An electrical plug device arranged on an electrical module is known in general from the market, whereby the module can be separably connected for example to a supply voltage and/or a control voltage or the like. Such a module may be, for example, a volume control valve of a high-pressure fuel pump for a fuel system of a motor vehicle. Here, it is generally necessary to form the entire electrical plug device in a type-specific manner depending on an embodiment of an electrical contact partner. This may concern both an embodiment of a housing of the electrical plug device and an embodiment of one or more contact elements.

SUMMARY

The problem addressed by the disclosure is solved by an electrical plug device and by a volume control valve and a method according to the description below. Advantageous developments are specified below. Features important for the disclosure can also be found in the following description and in the drawings, wherein the features may be important for the disclosure both in isolation and in different combinations, without reference being made again hereto explicitly.

The disclosure relates to an electrical plug device for the connection of a magnet coil and/or of a sensor element to a contact partner of a counterpiece cooperating with the electrical plug device. In accordance with the disclosure, the electrical plug device has at least one first portion, which comprises the magnet coil and/or the sensor element and at least one electrical contact element, the magnet coil and/or the sensor element and the at least one electrical contact element of the first portion being non-detachably interconnected. The electrical plug device furthermore comprises a second portion, which is produced separately from the first portion and is type-specific in relation to the counterpiece and which is joined to the first portion and which surrounds the electrical contact element, at least in part. Here, the first portion is formed in a manner substantially matching a respective embodiment of the magnet coil or of the sensor element, but, with the exception of the at least one contact element, is formed in a type-unspecific manner with respect to the counterpiece. The second portion is formed at least in regions in a manner dependent on geometric dimensions of the counterpiece, that is to say in a type-specific manner in relation thereto.

Due to the separate production of the second portion, said portion can be produced very cost-effectively and for example can be stockpiled and can be completed by the first portion in accordance with a respective need so as to form the electrical plug device according to the disclosure. Here, the second portion generally does not have a dedicated contact element, but merely surrounds the contact element of the first portion at a predefined physical distance and thus takes on the task of a "plug collar", for example. The second portion can be formed as what is known as a "free-falling" injection-molded part. The electrical plug device can thus be produced particularly easily and at the same time cost-effectively.

For example, this concerns automobile manufacture, where identical electrical modules, in particular those with a magnet coil or a sensor element, are fabricated for cars of different manufactures and therefore for different counterpieces. A "modular principle" so to speak is thus made possible, in which the standardized production processes and assembly processes of the electrical plug device made possible in accordance with the disclosure enable a cost-effective adaptation to an existing variety of types of counterpieces. Furthermore, the plastics injection-molding processes necessary for the electrical plug device can be considerably simplified, and cycle times for production can thus be reduced. Costs for machines, facilities or other manufacturing equipment (MFE) and also initial tool costs (ITC) can be reduced. By means of "uniform processes" made possible in accordance with the disclosure, a manufacturing yield can be increased. In addition, a development outlay and approval outlay in the case of the construction of the electrical plug device according to the disclosure can be reduced.

By way of example, a one-time development phase and approval phase may suffice. A market introduction of variants of the electrical plug device can also be accelerated as a result. In particular, substantially identical "planned production costs" (PPC) can be enabled within a manufacturing line for a large number of embodiments of the electrical plug devices, independently of a respective distribution of the quantities. Furthermore, a type-specific delivery flexibility can be increased, and competitiveness can be increased.

In one embodiment of the disclosure, the second portion is joined to the first portion detachably with destruction, in particular by means of laser penetration welding, ultrasonic welding, vibration welding, hot-gas welding, adhesive bonding or pressing, and/or detachably without destruction, in particular by means of a latched connection. The first and the second portion are thus joined together in a particularly durable manner, whereby confusion is also avoided and costs can thus be saved. Alternatively, the first and the second portion can also be interconnected detachably without destruction by means of the latched connection. The first and the second portion at the join preferably have contours and surface properties which are particularly suitable for a respective connection technique.

In a further embodiment of the electrical plug device, the electrical contact element is formed in a type-specific manner in relation to the counterpiece. A subgroup of first portions can thus be created, which cooperate with a specific contact partner, which is otherwise accommodated however in a type-specific second portion.

The electrical contact element preferably has a first region surrounded by the first portion, by means of which region the electrical contact element is held on the first portion, it being possible to form said region here in a type-unspecific manner in relation to the contact partner to be connected. Accordingly, the electrical contact element has a second region, which is not surrounded by the first portion and which is formed in a type-specific manner in relation to the contact partner to be connected to the electrical contact element and thus enables the actual contact junction. In this way, the first portion of the electrical plug device can be produced substantially independently of a respective embodiment ("type") of the counterpiece, whereby the electrical plug device is simplified and the cost of said plug device is reduced.

In a further embodiment of the electrical plug device, the second portion has a first region, which faces the first portion and which is formed in a type-unspecific manner in relation to the counterpiece cooperating with the electrical plug device, and the second portion additionally has a second region, which faces the counterpiece and which is formed in a type-specific manner in relation to the counterpiece cooperating with the electrical plug device. A mechanical and electrical substantially uniform interface, which is thus independent of the type of the respective counterpiece, is thus produced between the first and the second portion of the electrical plug device. The electrical plug device according to the disclosure is thus simplified, whereby costs can be saved.

In accordance with the disclosure, the first portion may also comprise a retaining portion for the magnet coil and/or the sensor element and the electrical contact element, the retaining portion being connected to the magnet coil and/or to the sensor element and the at least one electrical contact element. By way of example, the retaining portion may be formed as what is known as a "free-falling" injection-molded part and comprises a coil former or winding carrier for the magnet coil as well as a receiving portion for a region of the electrical contact element. The retaining portion is preferably formed in a type-unspecific manner and therefore "universally". An assembly of the electrical plug device can thus be simplified, and the cost of said plug device can be reduced. In this embodiment of the disclosure, the retaining portion is generally surrounded completely by a plastics overmolding, which will be explained in greater detail further below.

Alternatively, the retaining portion is formed in such a way that it is joined or can be joined to a first region of the second portion, which first region faces the retaining portion and is formed in a type-unspecific manner in relation to the counterpiece cooperating with the electrical plug device. The second portion can thus be directly joined to the retaining portion, whereby further advantageous embodiments of the electrical plug device are made possible. In this embodiment, the retaining portion in particular at the join generally is not surrounded completely by said plastics overmolding.

Furthermore, the electrical contact element may be an electrical contact pin, in particular a flat pin. Due to the embodiment as a contact pin, a corresponding contact element of the counterpiece can be formed as a socket, whereby a risk of short circuit can be reduced. Particularly high currents are possible due to the embodiment as a flat pin.

In a further embodiment of the electrical plug device, the first portion has a plastics overmolding, by means of which elements associated with the first portion are interconnected non-detachably. These elements in particular are the magnet coils and the first region of the electrical contact element and also optionally the retaining portion, which is encased at least in part by the plastics overmolding. Due to the plastics overmolding, the elements of the first portion are mechanically fixed to one another in a particularly simple manner and can simultaneously be sealed with respect to ambient influences, whereby the robustness of the electrical plug device is improved.

In a preferred embodiment of the disclosure, the separately produced second portion is a member of a set of differently formed second portions. The second portions can thus be produced separately from the first portion and can be joined to the first portion in accordance with a respective requirement of type-specific electrical plug devices. The production of the electrical plug device is thus simplified, and the cost of said plug device is reduced.

The disclosure also relates to a volume control valve for a high-pressure fuel pump of a fuel system for an internal combustion engine, wherein the volume control valve comprises at least one electrical plug device corresponding to the above-described embodiments.

The disclosure also relates to a first method for producing the electrical plug device, wherein this is produced with use of the following steps:

- assembling a magnet coil and/or a sensor element and at least one electrical contact element on the retaining portion;
- contacting the magnet coil and/or the sensor element on the at least one electrical contact element;
- overmolding the magnet coil and/or the sensor element and the retaining portion and region of the at least one electrical contact element by means of a plastics overmolding;
- separately producing the second portion of the electrical plug device;
- joining the second portion of the electrical plug device to the first portion by means of laser penetration welding, ultrasonic welding, vibration welding, hot-gas welding, adhesive bonding, pressing and/or latching, such that the second portion surrounds the electrical contact element at least in part.

In this first method, the electrical contact element is fixed on the retaining portion, before the magnet coil or the sensor element and the first region of the electrical contact element are overmolded by the plastic.

Furthermore, the disclosure relates to a second method for producing the electrical plug device, wherein this is produced with use of the following steps:

- assembling a magnet coil and/or a sensor element on the retaining portion;
- contacting the magnet coil and/or the sensor element on at least one electrical contact element;
- placing the magnet coil and/or the sensor element and the at least one electrical contact element in an injection mold;
- overmolding the magnet coil and/or the sensor element and the retaining portion and a region of the at least one electrical contact element by means of a plastics overmolding;
- separately producing the second portion of the electrical plug device;
- joining the second portion of the electrical plug device to the first portion by means of laser penetration welding, ultrasonic welding, vibration welding, hot-gas welding, adhesive bonding, pressing and/or latching, such that the second portion surrounds the electrical contact element at least in part.

In this second method, the electrical contact element is fixed on the injection mold before the magnet coil or the sensor element and the first region of the electrical contact element are overmolded jointly by the plastic. Once the plastic has cured, the electrical contact element is thus held substantially by the plastics overmolding. In particular, the retaining portion can thus be formed in a particularly simple manner or can even be omitted, whereby costs can be saved.

In an embodiment of the first and/or second method, the first portion comprises at least two electrical contact elements, which are produced integrally with use of at least one web, wherein the web is not surrounded by the first portion, and wherein the web, following the overmolding of the magnet coil and/or of the sensor element and of the retaining portion and of the first region of the at least one electrical contact element by means of the plastics overmolding, is removed by means of stamping or milling or notching. This has the advantage that the two electrical contact elements are fixed particularly precisely relative to one another, independently of an assembly in the retaining portion or in the injection mold. Only once the plastics overmolding has cured is the web removed, wherein an electrical connection between the two electrical contact elements is generally spared at the same time.

BRIEF DESCRIPTION OF THE DRAWINGS

Exemplary embodiments of the disclosure will be explained hereinafter with reference to the drawing, in which:

FIG. 2 shows a perspective illustration of a first portion for a first embodiment of an electrical plug device for the connection of a magnet coil of a volume control valve of the fuel pump from FIG. 1 to a contact partner;

FIG. 3 shows a partial axial sectional view of the first portion and of a second portion of the electrical plug device from FIG. 2;

DETAILED DESCRIPTION

In all figures, like reference signs are used for functionally equivalent elements and variables, even in different embodiments.

Figure 1:
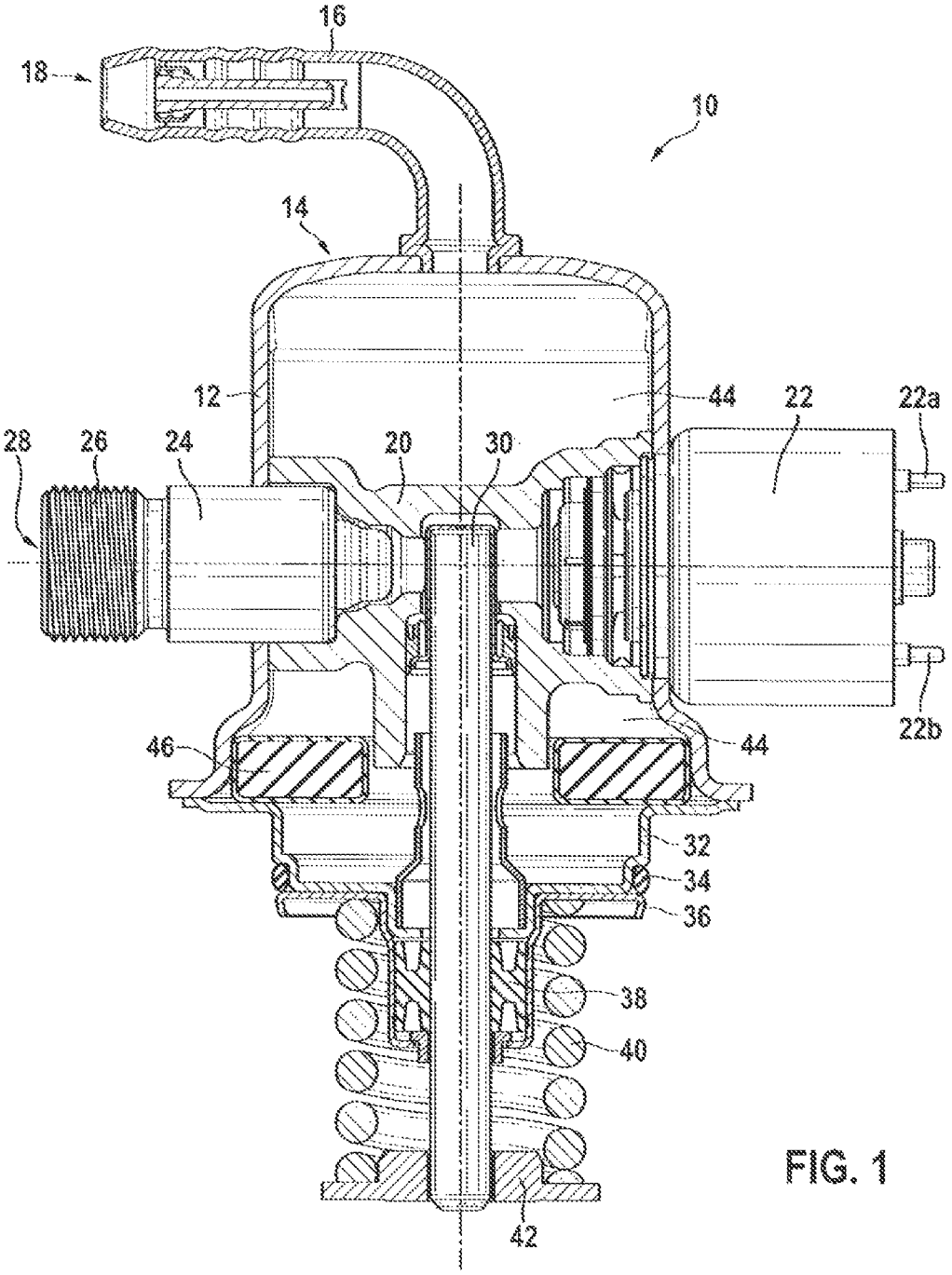
FIG. 1 shows a longitudinal section through a fuel pump of a fuel system of an internal combustion engine.

FIG. 1 shows a high-pressure fuel pump 10 of a fuel system (not illustrated) for an internal combustion engine (likewise not illustrated). The high-pressure fuel pump 10 has a substantially rotationally symmetrical housing 12, which can be screwed to an engine block of the internal combustion engine by means of a flange (not illustrated). In an upper region in the drawing, the high-pressure fuel pump 10 comprises a cover 14, which is arranged on the housing 12 in an integrated manner. An inlet connection piece 16 for the connection of the high-pressure fuel pump 10 to a low-pressure line 18 is arranged on the cover 14.

The high-pressure fuel pump 10 further comprises, in a middle region of FIG. 1, a housing core 20, which is arranged radially within the housing 12 and is connected thereto in portions. In a right-hand region of FIG. 1, a volume control valve 22 is arranged on the housing core 20, and an outlet valve 24 with an outlet connection piece 26 for connection to a high-pressure line 28 is arranged in a left-hand region. The volume control valve 22 can be electrically contacted in the present case by means of two electrical terminals 22*a* and 22*b*. The illustration of the electrical terminals 22*a* and 22*b* according to FIG. 1 is to be understood merely as a place marker for an electrical plug device 52, which will be described in detail further below by means of FIGS. 2 to 8.

A piston 30 of the high-pressure fuel pump 10 is illustrated in FIG. 1 in an upper end position. The following further elements, inter alia, are arranged in a lower region of the high-pressure fuel pump 10 in FIG. 1: a seal support 32, which is formed as a thermoformed part and which is connected in a fluid-tight manner to a lower portion of the housing 12; a seal 34, which is formed as an O-ring and which is arranged on the seal support 32; a spring receptacle 36, which is formed as a thermoformed part and which is arranged on a lower end face of the seal support 32 in the drawing; a piston seal 38 which is arranged radially within the spring receptacle 36; a piston spring 40, which is arranged on a radially outer portion of the spring receptacle 36; and a spring washer 42, which is arranged on a lower end portion of the piston spring 40 in FIG. 1 and at which the piston spring 40 is supported.

A fluid chamber 44 arranged within the housing 12 corresponds to a low-pressure region of the high-pressure fuel pump 10 filled with fuel. The fluid chamber 44 surrounds the inner housing core 20. In a lower region of the fluid chamber 44 in FIG. 1, a damping means 46 formed annularly in the present case is arranged concentrically with the piston 30 and the housing 12. A radially outer portion of the damping means 46 is arranged on a lower radially inner portion of the housing 12 in FIG. 1. A portion of a lower end face of the damping means 46 in FIG. 1 also rests on the seal support 32.

FIG. 2 shows a first portion 50 of the electrical plug device 52 for connection of a magnet coil 54 of the volume control valve 22 to a contact partner (not illustrated) cooperating with the electrical plug device 52. The first portion 50 comprises inter alia the magnet coil 54, two electrical contact elements 56*a* and 56*b*, and also a retaining portion 62 (see FIG. 3) not visible in FIG. 1 since it is overmolded.

The retaining portion 62 enables in particular a fixing of a copper winding of the magnet coil 54 and a fixing of the electrical contact elements 56*a* and 56*b*. An electrical connection between the copper winding and the electrical contact elements 56*a* and 56*b* is produced for example by means of clamping, screwing, soldering or spot-welding. The electrical contact elements 56*a* and 56*b* are formed in the present case as flat pins, and the contact partners (not illustrated) are formed accordingly as flat sockets.

The first portion 50 has a thermoplastic overmolding 57, by means of which elements associated with the first portion 50, that is to say the magnet coil 54, the two electrical contact elements 56*a* and 56*b* and also the retaining portion 62, are interconnected non-detachably. In particular, the electrical contact elements 56*a* and 56*b* have a first region (not provided with reference sign in FIG. 1), which is surrounded by the plastics overmolding 57, which thus mechanically fixes the electrical contact elements 56*a* and 56*b*, at least in a supplementary manner. The electrical contact elements 56*a* and 56*b* further have a second region (also without reference sign), which is not surrounded by the plastics overmolding 57. At least the second region of the electrical contact elements 56*a* and 56*b* is formed in a type-specific manner in relation to the contact partner cooperating with the electrical plug device 52.

A left rear region of the plastics overmolding 57 in FIG. 2 surrounds the magnet coil 54 and also a first part of the retaining portion 62, which in the present case comprises a coil former for the copper winding of the magnet coil 57. A right front region of the plastics overmolding 56 in FIG. 2 surrounds a second part of the retaining portion 62, which in the present case mechanically fixes the first region of the electrical contact elements 56*a* and 56*b* (additionally to the plastics overmolding 57).

In one embodiment of the electrical plug device 52, the retaining portion 62 comprises merely the above-mentioned first part. When producing this embodiment, the electrical contact elements 56*a* and 56*b* are first fixed in an injection mold, and the magnet coil 54, the retaining portion 62 and the first region of the electrical contact elements 56*a* and 56*b* are then overmolded by the plastic. In this regard, see the flow diagram of FIG. 10 further below.

An arrow 55 characterizes a region with approximately elliptical cross section in the present case, at which the first portion 50 can be joined to a second portion 60*a* (see FIG. 3) of the electrical plug device 52. In the present case, this region comprises a radially peripheral rib 59, by means of which the second portion 60*a* can be latched on the first portion 50 for the assembly of the electrical plug device 52. This latching is performed for example in such a way that the second portion 60*a* can be detached from the first portion 50 without destruction. This may facilitate a potential necessary repair of the electrical plug device 52. Alternatively, the first portion 50 has a groove instead of the rib 59.

In the present case, the two electrical contact elements 56*a* and 56*b* are produced integrally with use of a web 58, wherein the web 58 is not surrounded by the plastics overmolding 57. With the production of the electrical plug device 52, the web 58 is removed, for example by means of stamping or milling or notching, following the overmolding of the magnet coil 54, of the retaining portion 62 and of said first region of the electrical contact elements 56*a* and 56*b*.

In an embodiment (not illustrated) of the electrical plug device 52, this is used for the connection of a sensor element. In FIGS. 2 to 8, the sensor element therefore replaces the magnet coil 54. Such a sensor element may be, for example, a phase sensor, a rotational speed sensor, a pressure sensor, an exhaust gas sensor, a sensor for determining flow rates, and the like.

FIG. 3 shows the first portion 50 of the electrical plug device 52 and the second portion 60, which is produced separately from the first portion 50, is formed in a type-specific manner in relation to the counterpiece, is joined to the first portion 50 and surrounds the electrical contact elements 56*a* and 56*b* in the present case completely with a predefined physical distance. Here, a region (to the left in FIG. 3) of the first portion 50 encasing the magnet coil 54 is illustrated in a side view. A region (in the middle in FIG. 3) surrounding the second part of the retaining portion 62 and the first region of the electrical contact elements 56*a* and 56*b* and also the second portion 60*a* are illustrated in FIG. 3 in an axial sectional view.

In the sectional view, the second part of the retaining portion 62 is indicated by means of dashed lines in the middle region of FIG. 3. It can be seen that the electrical contact elements 56*a* and 56*b* are encased in part by the retaining portion 62 and are thus (additionally) mechanically fixed.

The second portion 60*a* is preferably formed in such a way that it has a first region 64, which faces the first portion 50 and which is formed in a type-unspecific manner in relation to the counterpiece cooperating with the electrical plug device 52, and in such a way that the second portion 60*a* has a right-hand second region 66 in FIG. 3, which faces the counterpiece and which is formed in a type-specific manner in relation to the counterpiece cooperating with the electrical plug device 52.

The first portion 50 can be joined to the second portion 60*a* not only by means of the above-described latching, but alternatively or additionally by further methods: by way of example, by means of laser penetration welding, ultrasonic welding, vibration welding, hot-gas welding, and/or adhesive bonding or pressing. The joining is performed in such a way that the first portion 50 and the second portion 60*a*, following assembly, cannot be detached from one another without destruction.

In an embodiment (not illustrated) of the electrical plug device 52, the retaining portion 62 is formed in such a way that it is joined or can be joined to a first region 64 of the second portion 60, which first region faces the retaining portion 62 and is formed in a type-unspecific manner in relation to the counterpiece cooperating with the electrical plug device 52. The difference from the embodiment shown in FIGS. 2 and 3 lies in this case in the fact that the above-described second part of the retaining portion 62 is "solid" so to speak and therefore merely the first part of the retaining portion 62 together with the magnet coil 54 is encased by the plastics overmolding 57.

Figure 4:
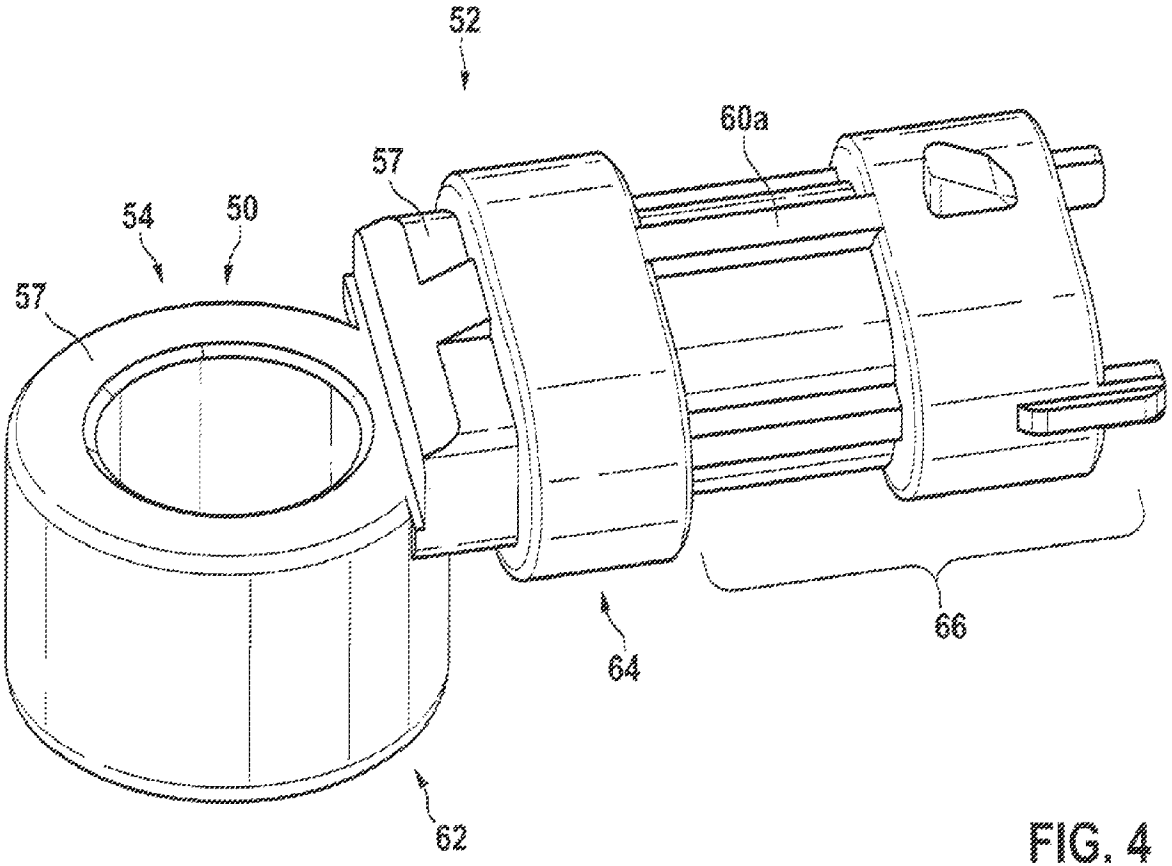
FIG. 4 shows a perspective illustration of the first embodiment of the electrical plug device from FIG. 3.
Figure 5:
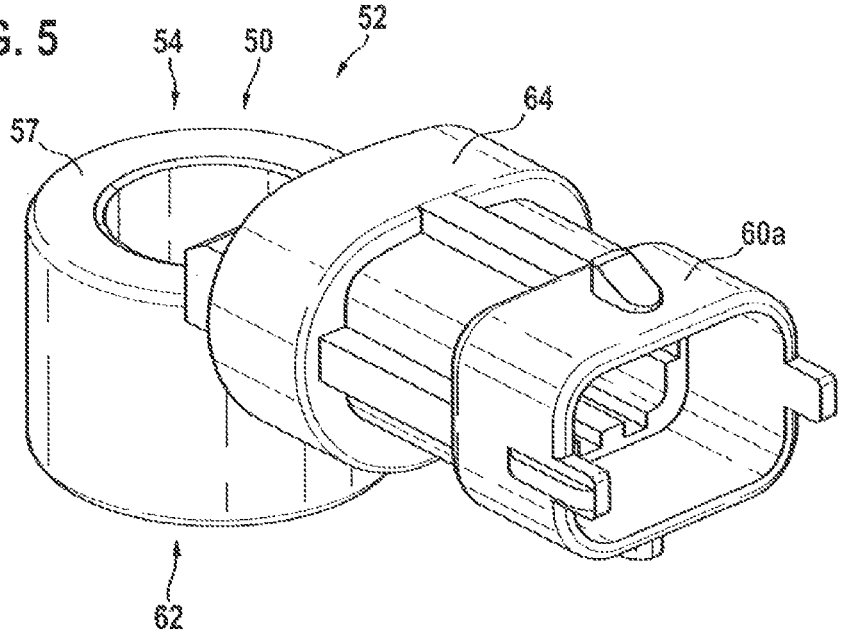
FIG. 5 shows another perspective illustration of the first embodiment of the electrical plug device.
Figure 6:
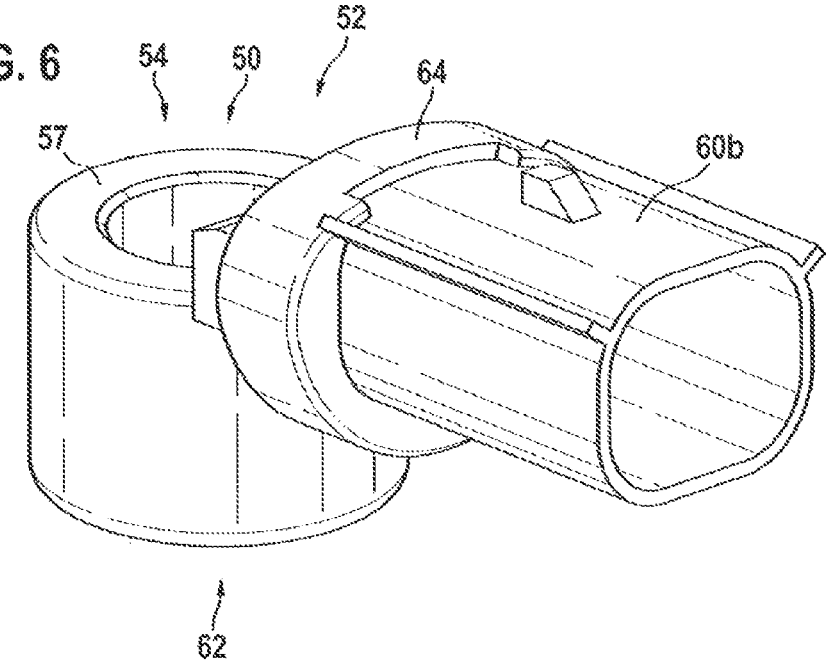
FIG. 6 shows a perspective illustration of a second embodiment of the electrical plug device.
Figure 7:
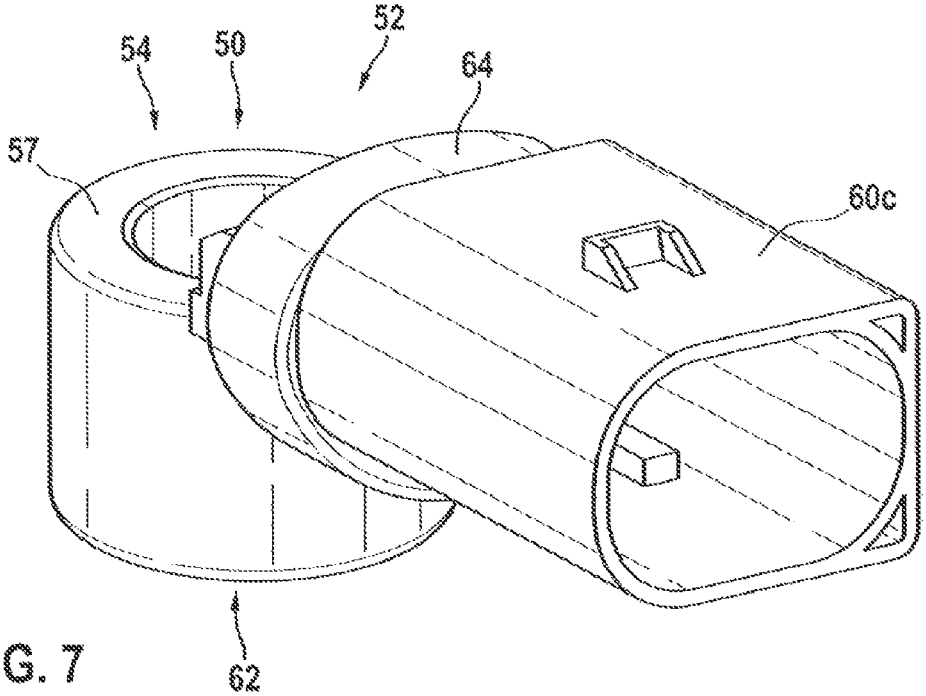
FIG. 7 shows a perspective illustration of a third embodiment of the electrical plug device.
Figure 8:
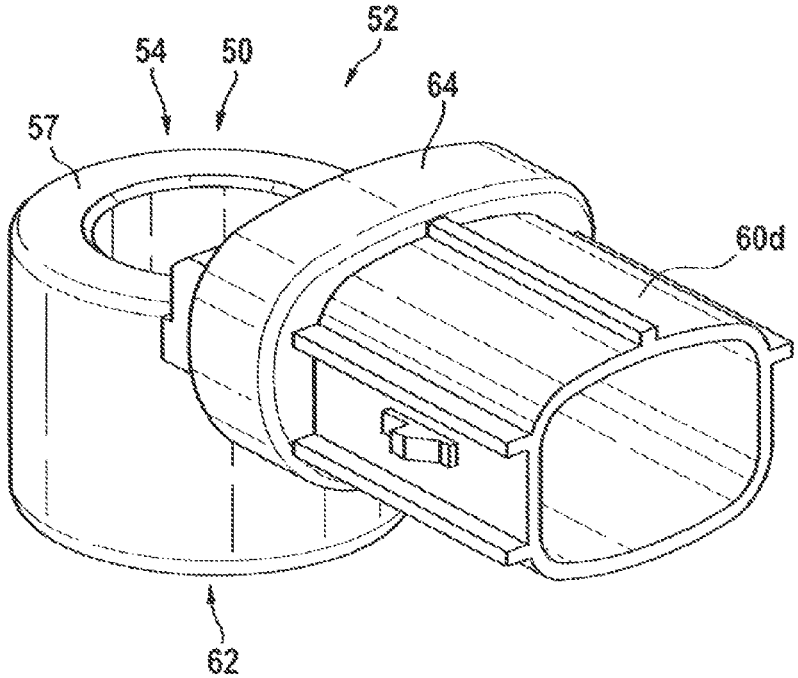
FIG. 8 shows a perspective illustration of a fourth embodiment of the electrical plug device.

FIGS. 4 and 5 show the electrical plug device 52 of FIG. 3 in a perspective illustration. FIGS. 6 to 8 show further embodiments of the electrical plug device 52 in a respective perspective illustration. Compared with the embodiments according to FIGS. 2 to 5, further electrical plug devices 52 are thus additionally shown, in which the respective electrical contact elements 56*a* and 56*b* and also the respective second portions 60*a*, 60*b*, 60*c* and 60*d* are likewise formed in a type-specific manner in relation to the counterpiece cooperating with the electrical plug device 52. In particular, the separately produced second portions 60*a*, 60*b*, 60*c* and 60*d* are members of a set of differently formed second portions 60*a*, 60*b*, 60*c* and 60*d*.

Here, an advantage of the electrical plug device 52 according to the disclosure lies in the fact that the first portion 50 is formed in a substantially type-unspecific manner. In particular, only a single injection mold is necessary for the first portion 50, wherein the electrical contact elements 56*a* and 56*b* are formed in a manner matching the type-specific second portions 60*a*, 60*b*, 60*c* and 60*d* and are also placed in the injection mold in accordance with a respective requirement.

By way of example, the volume control valve 22 shown in FIG. 1 can be attached in a type-specific manner by means of the electrical plug device 52 to the counterpieces of the electrical plug device 52 used by a respective manufacturer of a motor vehicle, wherein the production of the electrical plug device 52 or of the volume control valve 22 is simplified in accordance with the disclosure, and the cost is thus reduced.

Figure 9:
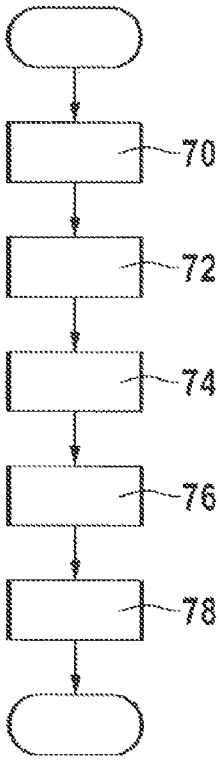
FIG. 9 shows a flow diagram for a first method for producing the electrical plug device.

FIG. 9 show a flow diagram for carrying out a first method for producing the electrical plug device 52.

In a first method step 70, the magnet coil 54 is produced and assembled, for example by winding the copper winding on the retaining portion 62. The electrical contact elements 56*a* and 56*b* are then also mounted on the retaining portion 62.

In a second method step 72, the magnet coil 54 is contacted with the electrical contact elements 56*a* and 56*b*.

In a third method step 74, the magnet coil 54 arranged on the retaining portion 62 and the first region of the electrical contact elements 56*a* and 56*b* are overmolded in a first injection mold by means of the plastics overmolding 57.

In a fourth method step 76, the second portion 60*a, b, c* or *d* of the electrical plug device 52 is produced separately by means of a type-specific second injection mold.

In a fifth method step 78, the second portion 60*a, b, c* or *d* and the first portion 50 are joined together by means of laser penetration welding, ultrasonic welding, vibration welding, hot-gas welding, adhesive bonding, pressing and/or latching.

Figure 10:
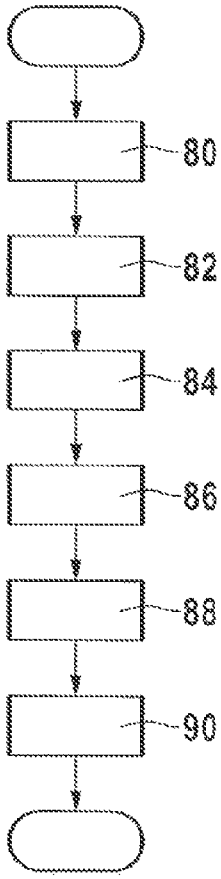
FIG. 10 shows a flow diagram for a second method for producing the electrical plug device.

FIG. 10 shows a flow diagram for carrying out an alternative second method for producing the electrical plug device 52.

In a first method step 80, the magnet coil 54 is produced and assembled, for example by winding the copper winding on the retaining portion 62.

In a second method step 82, the magnet coil 54 is contacted with the electrical contact elements 56*a* and 56*b*. Here, the electrical contact elements 56*a* and 56*b* are only fixed loosely or even not at all on the magnet coil 54 or on the retaining portion 62.

In a third method step 84, the magnet coil 54 and the electrical contact elements 56*a* and 56*b* arranged on the retaining portion 62 are placed in an injection mold.

In a fourth method step 86, the magnet coil 54, the retaining portion 62 and the first region of the electrical contact elements 56*a* and 56*b* are overmolded by means of the plastics overmolding 57.

In a fifth method step 88, the second portion 60*a, b, c*, or *d* of the electrical plug device 52 is produced separately by means of a specific injection-molding mold.

In a sixth method step 90, the second portion 60*a, b, c* or *d* and the first portion 50 are joined together by means of laser penetration welding, ultrasonic welding, vibration welding, hot-gas welding, adhesive bonding, pressing and/or latching.

What is claimed is:

1. An electrical plug device for the connection of a magnet coil and/or of a sensor element to a contact partner of a counterpiece cooperating with the electrical plug device, the electrical plug device comprising:

at least one first portion including:

the magnet coil and/or the sensor element;

at least one electrical contact element; and a plastics overmolding, the magnet coil and/or the sensor element and the at least one electrical contact element of the at least one first portion being non-detachably interconnected via the plastics overmolding; and a second portion produced separately from the at least one first portion and type-specific in relation to the counterpiece, wherein the second portion is joined to the at least one first portion and at least partially surrounds the at least one electrical contact element.

2. The electrical plug device according to claim 1, wherein the at least one electrical contact element is formed in a type-specific manner in relation to the counterpiece.

3. The electrical plug device according to claim 1, wherein:

the second portion has a first region facing the at least one first portion and formed in a type-unspecific manner in relation to the counterpiece cooperating with the electrical plug device, and the second portion has a second region facing the counterpiece and formed in a type-specific manner in relation to the counterpiece cooperating with the electrical plug device.

4. The electrical plug device according to claim 1, wherein the separately produced second portion is a member of a set of differently formed second portions.

5. The electrical plug device according to claim 1, wherein the electrical plug device is included in a volume control valve for a high-pressure fuel pump.

6. The electrical plug device according to claim 1, wherein:

the at least one first portion includes a retaining portion for at least one of the magnet coil, the sensor element, and the at least one electrical contact element, and the retaining portion is connected to the at least one of the magnet coil, the sensor element, and the at least one electrical contact element.

7. The electrical plug device according to claim 6, wherein the retaining portion is formed so as to be joined to a first region of the second portion, the first region facing the retaining portion and formed in a type-unspecific manner in relation to the counterpiece cooperating with the electrical plug device.

8. The electrical plug device according to claim 1, wherein the second portion is joined to the at least one first portion so as to be detachable with and/or without destruction.

9. The electrical plug device according to claim 8, wherein the second portion is joined to the at least one first portion detachably with destruction by one of laser penetration welding, ultrasonic welding, vibration welding, hot-gas welding, adhesive bonding and pressing.

10. The electrical plug device according to claim 8, wherein the second portion is joined to the at least one first portion detachably without destruction by latching.

11. The electrical plug device according to claim 1, wherein the at least one electrical contact element is an electrical contact pin.

12. The electrical plug device according to claim 11, wherein the electrical contact pin is a flat pin.

13. A method for producing an electrical plug device, comprising:

assembling a magnet coil and/or a sensor element and at least one electrical contact element on a retaining portion of a first portion of the electrical plug device;

contacting the magnet coil and/or the sensor element on the at least one electrical contact element;

non-detachably interconnecting the magnet coil and/or the sensor element and the at least one electrical contact element by overmolding the magnet coil and/or the sensor element and the retaining portion and a region of the at least one electrical contact element by a plastics overmolding;

separately producing a second portion of the electrical plug device; and joining the second portion of the electrical plug device to the first portion by at least one of laser penetration welding, ultrasonic welding, vibration welding, hot-gas welding, adhesive bonding, pressing, and latching, such that the second portion at least partially surrounds the at least one electrical contact element.

14. The method according to claim 13, wherein:

the first portion includes at least two electrical contact elements produced integrally with at least one web, the at least one web is not encased by the first portion, and following the overmolding of the magnet coil and/or the sensor element and the retaining portion and the region of the at least one electrical contact element by the plastics overmolding, the at least one web is removed by one of stamping, milling, and notching.

15. A method for producing an electrical plug device, comprising:

assembling a magnet coil and/or a sensor element on a retaining portion of a first portion of the electrical plug device;

contacting the magnet coil and/or the senor element on at least one electrical contact element;

placing the magnet coil and/or the sensor element and the at least one electrical contact element in an injection-molded mold;

non-detachably interconnecting the magnet coil and/or the sensor element and the at least one electrical contact element by overmolding the magnet coil and/or the sensor element and the retaining portion and a region of the at least one electrical contact element by a plastics overmolding;

separately producing a second portion of the electrical plug device; and joining the second portion of the electrical plug device to the first portion by at least one of laser penetration welding, ultrasonic welding, vibration welding, hot-gas welding, adhesive bonding, pressing, and latching, such that the second portion at least partially surrounds the at least one electrical contact element.

16. The method according to claim 15, wherein:

the first portion includes at least two electrical contact elements produced integrally with at least one web, the at least one web is not encased by the first portion, and following the overmolding of the magnet coil and/or the sensor element and the retaining portion and the region of the at least one electrical contact element by the plastics overmolding, the at least one web is removed by one of stamping, milling, and notching.

* * * * *